US009643189B2

(12) United States Patent
Greiner

(10) Patent No.: US 9,643,189 B2
(45) Date of Patent: May 9, 2017

(54) BLADE SET FOR A MEAT GRINDER

(71) Applicant: HEINRICH GMBH, Nuertingen-Zizishausen (DE)

(72) Inventor: Wolfgang Greiner, Nuertingen (DE)

(73) Assignee: Heinrich GmbH, Nuertingen-Zizishausen (DE)

( * ) Notice: Subject to any disclaimer, the term of this patent is extended or adjusted under 35 U.S.C. 154(b) by 139 days.

(21) Appl. No.: 14/425,413

(22) PCT Filed: Aug. 21, 2013

(86) PCT No.: PCT/EP2013/067398
§ 371 (c)(1),
(2) Date: Mar. 3, 2015

(87) PCT Pub. No.: WO2014/037223
PCT Pub. Date: Mar. 13, 2014

(65) Prior Publication Data

US 2015/0251189 A1 Sep. 10, 2015

(30) Foreign Application Priority Data

Sep. 5, 2012 (DE) ..... 10 2012 108 245

(51) Int. Cl.
*B02C 18/36* (2006.01)
*B02C 18/30* (2006.01)

(52) U.S. Cl.
CPC ..... *B02C 18/362* (2013.01); *B02C 18/365* (2013.01); *B02C 2018/308* (2013.01); *B02C 2018/367* (2013.01)

(58) Field of Classification Search
CPC ..... B02C 18/362; B02C 18/365; B02C 2018/308; B02C 2018/367; B02C 18/36
USPC ..... 241/82.1–82.7
See application file for complete search history.

(56) References Cited

U.S. PATENT DOCUMENTS 1,889,381 A 11/1932 Rush

FOREIGN PATENT DOCUMENTS

| | | |
|---|---|---|
| DE | 577208 | 5/1933 |
| DE | 679144 | 7/1939 |
| DE | 4437144 | 4/1996 |
| DE | 29905706 | 7/1999 |
| GB | 363229 | 12/1931 |

*Primary Examiner* — Mark Rosenbaum
(74) *Attorney, Agent, or Firm* — Michael J. Striker

(57) ABSTRACT

A set of cutters for a mincer with at least one perforated disc (12, 14) and with a cutter holder (11, 13) able to be driven in a rotating manner by the shaft (15) of the mincer, wherein on the cutter holder (11, 13) several cutters (25, 26, 27, 28) are rotatably arranged about axes which are aligned parallel to the shaft (15) of the mincer.

13 Claims, 2 Drawing Sheets

BLADE SET FOR A MEAT GRINDER

CROSS-REFERENCE TO RELATED APPLICATION

Figure 1:
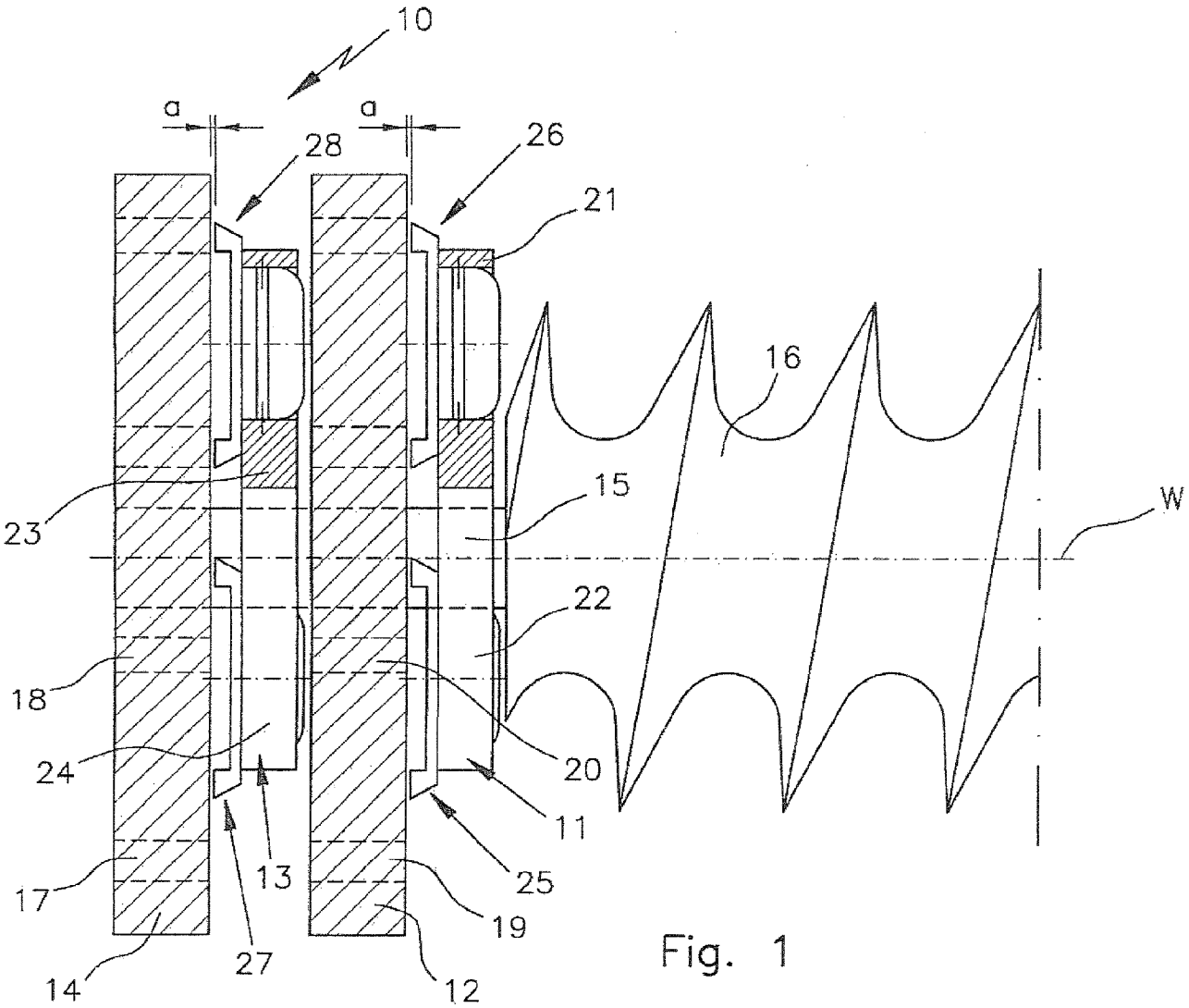

The invention described and claimed hereinbelow is also described in German patent Application 10 2012 108 245.6 filed on Sep. 5, 2012. This German Patent Application, whose subject matter is incorporated here by reference, provides the basis for a claim of priority of invention under 35 U.S.C. 119 (a)-(d).

A mincer is used for the grinding of meat in particular in the production of sausages. As the meat can also contain sinews and cartilage, a grinding is generally carried out by several sets of cutters arranged one behind the other, consisting of a perforated disc and of a rotating cutter arranged in front. The cutters themselves are formed by cutter holders with several arms having cutter blades fitted thereon, projecting outwards from a hub, wherein the cutter blades extend parallel to the arms. The cutters are braced with a high contact pressure in axial direction with the perforated discs, in order to obtain a high cutting performance. High frictional forces arise thereby between the blades and the perforated disc. Perforated discs and cutter blades therefore wear relatively quickly and the resulting metal abraded material arrives into the sausage material. To reduce these problems, a set of cutters has been proposed in DE 44 37 144 A1, in which the cutter blades are arranged so as to be axially movable on the cutter holder and are pressed against the perforated disc by the working pressure of the material which is for cutting. The blade holders no longer have to be pre-tensioned axially against the perforated discs, whereby the frictional losses are noticeably reduced.

The present invention is based on the problem of providing a set of cutters in which the wear of the perforated discs and cutter blades is further reduced compared with the known solutions.

The problem is solved by a set of cutters for a mincer with at least one perforated disc and with a blade holder drivable in a rotating manner by the shaft of the mincer, characterized in that on the cutter holder several cutters are arranged rotatably about axes which are aligned parallel to the shaft of the mincer.

By the rotatably mounted cutters, which in turn are moved by the cutter holder along the perforated disc, a distinctly better cutting performance is produced, as has been shown in tests. With this set of cutters, the material which is for cutting is ground to a distinctly higher percentage in fact by cutting and not by crushing than in known sets of cutters. Thereby also less wear both of the perforated disc and also of the cutters occurs. Less metallic abraded material arrives into the sausage material. The driving power of the mincer can be reduced. Furthermore, less development of heat occurs through the friction between the cutter blades and the perforated disc and hence also less heating of the material which is for cutting, which benefits the quality of the sausage.

To achieve a uniform coverage of the perforated disc by the rotatable cutters, the rotation axes of the cutters can preferably be arranged on one or more circles around the shaft axis of the mincer. Here, it is additionally advantageous if the cutters respectively have the same angular distance.

In a preferred embodiment of the set of cutters, the cutters are constructed rotationally symmetrically. In particular, they can be round or polygonal. They can thereby rotate easily and uniformly through the material which is for cutting, which is held secure by the perforated disc, when they are moved by the cutter holder along the perforated disc. Furthermore, in this embodiment the cutters are simple to clean. It is advantageous here if the cutters are provided with blades on their periphery. The pressure distribution occurring thereby between cutters and perforated disc is more favourable than in the case of the radially outwardly directed blades of known sets of cutters. A laminar load of the disc is produced, instead of a linear load, which further reduces the deformation and hence the wear of the perforated disc. Furthermore, thinner perforated discs can be used than in known sets of cutters. The cutter foot can preferably be round, whilst the blades can also be arranged for example on a polygon around the rotation axis of the cutter.

The cutters can also have several wings which are respectively provided with blades. In this embodiment it is also favourable, for the reasons described above, if the blades are arranged on the radially outer periphery of the wings. Here, the wings can also have different lengths.

The blades can preferably form a cutting angle of 30° to 60° with the perforated disc. Very good results have been produced in tests with cutting angles of 45°. In conventional sets of cutters, on the other hand, the cutting angles are distinctly greater, which leads to poorer cutting results. The blades sharpen themselves during the cutting process on the harder perforated disc. The cutting angle is maintained even in the case of wear.

Further advantages arise when the cutters are arranged exchangeably on the cutter holder by means of a plug-in connection. They can thereby be easily exchanged and cleaned.

It is particularly preferred if the cutters are arranged axially movably in the cutter holder. Thereby, a cutting effect only occurs when the material which is for cutting is pressed against the cutters. The working pressure of the material for cutting which is brought forward by a worm of the mincer is sufficient here to produce a clean cutting effect. If no material which is for cutting is delivered, the friction between perforated disc and cutter is only minimal.

Even better cutting results and even less wear can be achieved if the cutters are mounted in a floating manner in the cutter holder. Thereby, the cutter blades always lie with the entire surface on the perforated disc during the cutting process, irrespective of whether or not the cutter holder and perforated disc are aligned exactly parallel to one another. Optimum cutting results occur, which is important in particular for the production of mincemeat products, steak tartare or salami.

The cutter holder can preferably be constructed in a disc shape, in order to ensure a flat and compact construction of the set of cutters. The installation of the set of cutters thereby also proves to be simple. An embodiment of the cutter holder with several wings is particularly advantageous here, on which wings respectively at least one cutter is arranged. The wings can be kept relatively narrow, so that the passage to the perforated disc by the material which is for cutting is scarcely impeded by the cutter holder.

Further advantages emerge when the cutter holder and/or the cutters have openings for the discharging of material which is for cutting which is not able to be ground. Such openings can be arranged for example close to the rotation axis of the cutters or of the cutter holder. From there, the rejected parts such as sinews or cartilage can be discharged for example via a tube, so that they do not clog the set of cutters.

If a high degree of grinding is to be achieved, the set of cutters can have, in a manner known per se, two perforated discs with cutter holders arranged in front with cutters, wherein the perforated discs have an increasingly smaller hole diameter in the throughput direction of the material which is for cutting.

Figure 3:
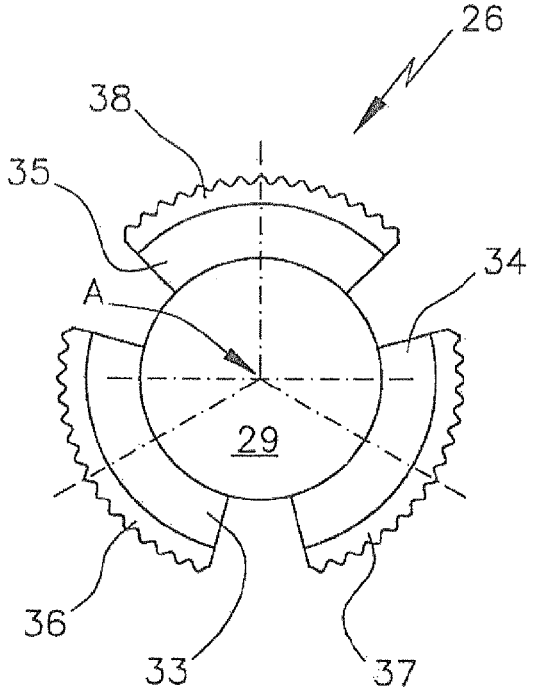
Figure 2:
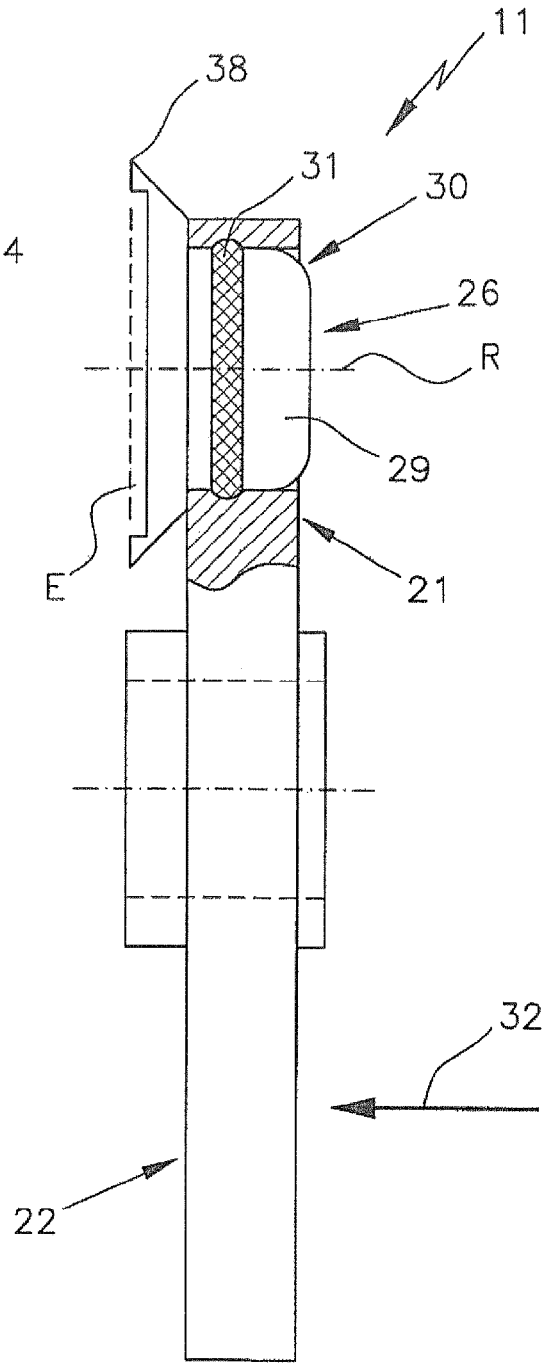

A preferred example embodiment of a set of cutters according to the invention is described in further detail below with the aid of the drawings. There are shown:

FIG. 1 a lateral view, partially in section, of a mincer worm with a set of cutters in place;

FIG. 2 an enlarged lateral view of a cutter holder with cutter of the set of cutters of FIG. 1;

FIG. 3 a top view onto a cutter of the set of cutters of FIG. 1.

FIG. 1 shows a set of cutters 10, which in the illustrated example has two perforated discs 12, 14 with cutter holders 11, 13 arranged respectively in front. The set of cutters 10 is placed onto a shaft 15 of a mincer worm 16, wherein the cutter holders 11, 13 are driven in a rotating manner jointly with the worm 16. In the illustrated example, the perforated discs 12, 14 have two radially spaced rows of holes 17, 18 or respectively 19, 20.

The cutter holders 11, 13 have three wings, of which two wings 21, 22 or respectively 23, 24 are to be seen in the lateral view. Each wing 21, 22, 23, 24 carries a cutter 25, 26, 27, 28, the shape and mounting of which are described in greater detail by means of the enlarged illustration of the cutter holder 11 in FIG. 1 and by means of FIG. 2. In the illustrated example, the wings 21, 22, 23, 24 are of equal length and are preferably spaced apart from one another respectively by 120°. The axes R (FIG. 2) of the cutters 25, 26, 27, 28 therefore lie on a circle around the shaft axis W, so that the cutters 25, 26, 27, 28 are moved over the rows of holes 17, 18, 19, 20, when the cutter holders 11, 13 rotate about the shaft axis W of the mincer. The cutters 25, 26, 27, 28 could, however, also lie on different circles. FIG. 1 illustrates in addition that the cutters 25, 26, 27, 28 in the unstressed state are arranged with a small axial distance a in front of the perforated discs 12, 14, when no material which is for cutting is to be processed. The mincer with the set of cutters 10 according to the invention can therefore also run in a wear-free manner without material.

FIG. 2 illustrates the mounting of the cutters 25 to 28 in the cutter holders 11, 13 using the example of the cutter 26. The cutter 26 has a round foot 29, which is inserted into a round through-bore 30 in the wing 21 and is mounted there by a sealing ring 31 so as to be axially movable and rotatable. The foot 29 can carry out, in addition, limited tilting movements in the through-bore 30, which is somewhat larger in diameter, so that the cutter 26 is additionally mounted in a floating manner in the cutter holder 11. Through the simple plug-in connection between cutter 26 and cutter holder 11, an easy installation and exchangeability of the cutter 26 is provided. The sealing ring 31, in addition, prevents the penetration of pieces of meat.

The cutter 26 has in addition a relief area E, the size of which depends on the material which is for cutting.

The axial mobility enables a pressing of the cutter 26 against the perforated disc 12 by the material for cutting, which is transported up thereto in arrow direction 32. Through the floating mounting, the cutter can then also lie here with the entire surface against the perforated disc 11, if this is not aligned exactly parallel to the cutter holder 11. In addition, the material which is for cutting can set the cutter 26 in rotation, whereby a very good cut quality is produced, as tests have shown. The material which is held secure by the openings 19, 20 of the perforated disc 12 is in fact cut at a distinctly higher percentage and not ground by crushing, as is the case in conventional sets of cutters.

As FIG. 3 shows, the cutter 26 has three wings 33, 34, 35, which carry blades 36, 37, 38 respectively on their outer periphery, which in the illustrated example are provided with a serrated edge. The blades 36, 37, 38 are configured in the form of a circular arc and all have the same radial distance to the rotation axis A of the cutter 26. The illustrated cutter shape here is only by way of example. The cutter 26 could also be round, i.e. could have no wings 33, 34, 35 and could carry a circular or polygonal blade. The shape of the cutter 26 can be selected according to the material for cutting which is to be processed and the end product which is to be produced. Through the simple plug-in connection between cutter 26 and cutter holder 11, the cutters can be quickly exchanged for cutters of a different shape.

The invention claimed is:

1. A set of cutters for attachment to and use with a mincer that is configured with at least one perforated disc and with a cutter holder that is able to be driven in a rotating manner by a shaft of the mincer, wherein each of the cutters has a rotational axes (R) and comprises:

several wings; and cutter blades;

wherein for mincer operation, the cutters are arranged on the cutter holder to be rotatable about the respective cutter rotational axes (R), which cutter rotational axes (R) are aligned parallel to the shaft of the mincer; and wherein the cutter blades are respectively provided on the several wings.

2. The set of cutters according to claim 1, wherein the rotation axes (R) of the cutters are arranged on one or more circles around a shaft axis (W) of the mincer upon arrangement of the cutters on the cutter holder.

3. The set of cutters according to claim 2, wherein the cutters respectively have a same angular distance.

4. The set of cutters according to claim 1, wherein the cutters are constructed rotationally symmetrically.

5. The set of cutters according to claim 1, wherein the cutter blades are provided on a periphery of each of the cutters.

6. The set of cutters according to claim 1, wherein the cutter blades are arranged on a radially outer periphery of the wings.

7. The set of cutters according to claim 1, wherein the cutter blades form a cutting angle of 30° to 60° with the perforated disc.

8. The set of cutters according to claim 1, wherein the cutters are arranged exchangeably on the cutter holder by a plug-in connection.

9. The set of cutters according to claim 1, wherein the cutters are arranged axially movably in the cutter holder.

10. The set of cutters according to claim 1, wherein the cutters are mounted in a floating manner in the cutter holder.

11. The set of cutters according to claim 1, wherein the cutter holder, is constructed in a disc shape.

12. The set of cutters according to claim 1, wherein the cutter holder, the cutters or both have openings for the discharging of material for cutting that is not able to be ground.

13. A mincer, comprising at least one perforated disc;

and a cutter holder that is driven in a rotating manner by a shaft of the mincer; and a set of cutters;

wherein each of the cutters has a rotational axes (R) and comprises several wings and cutter blades;

wherein the cutters are rotatably arranged on the cutter holder so that the respective cutter rotational axes (R) are aligned in parallel to the shaft of the mincer;

wherein the cutter blades are provided respectively on the several wings; and wherein at least two perforated discs with cutter holders are arranged in front with cutters; and wherein the at least two perforated discs have an increasingly smaller hole diameter in the throughput direction of the material which is for cutting.

* * * * *